US007435486B2

(12) United States Patent
Dahlund et al.

(10) Patent No.: US 7,435,486 B2
(45) Date of Patent: Oct. 14, 2008

(54) INSERT FOR METAL CUTTING

(75) Inventors: Silvia Dahlund, Söderbärke (SE); Andreas Larsson, Fagersta (SE)

(73) Assignee: Seco Tools AB, Fagersta (SE)

( * ) Notice: Subject to any disclaimer, the term of this patent is extended or adjusted under 35 U.S.C. 154(b) by 303 days.

(21) Appl. No.: 11/155,508

(22) Filed: Jun. 20, 2005

(65) Prior Publication Data

US 2006/0099433 A1 May 11, 2006

(30) Foreign Application Priority Data

Jul. 9, 2004 (SE) ..... 0401819

(51) Int. Cl.
*C23C 14/08* (2006.01)
*C23C 16/40* (2006.01)

(52) U.S. Cl. ..... 428/698; 51/307; 51/309; 428/212; 428/216; 428/336; 428/472; 428/697

(58) Field of Classification Search ..... 51/307, 51/309; 428/697, 698, 212, 216, 336, 472
See application file for complete search history.

(56) References Cited

U.S. PATENT DOCUMENTS 4,277,283 A * 7/1981 Tobioka et al. ..... 75/238
4,497,874 A * 2/1985 Hale ..... 428/698
4,548,786 A 10/1985 Yohe
4,610,931 A 9/1986 Nemeth et al.
5,232,318 A * 8/1993 Santhanam et al. ..... 407/119
5,250,367 A * 10/1993 Santhanam et al. ..... 428/698
5,380,408 A 1/1995 Svensson
5,484,468 A * 1/1996 Ostlund et al. ..... 75/236
5,665,431 A * 9/1997 Narasimhan ..... 428/698
5,729,823 A * 3/1998 Gustafson et al. ..... 428/698
5,800,868 A 9/1998 Lenander et al.
5,976,707 A 11/1999 Grab
6,554,548 B1 * 4/2003 Grab et al. ..... 407/119
7,150,897 B2 * 12/2006 Mikus ..... 51/309

FOREIGN PATENT DOCUMENTS

EP 1 043 415 A2 10/2000
JP 3-32502 2/1991

* cited by examiner

*Primary Examiner*—Archene Turner
(74) *Attorney, Agent, or Firm*—Drinker Biddle & Reath LLP

(57) ABSTRACT

A coated cutting insert for metal machining, in particular of short chipping materials, includes a tungsten carbide-based substrate with a binder phase enriched surface zone having at least one rake face and at least one clearance face intersecting to form a cutting edge. The binder phase enriched surface zone is at least partly missing on the rake face including at least a part of the surface extending from the cutting edge. As a result, an optimum combination of edge strength and wear resistance has been achieved.

19 Claims, 2 Drawing Sheets

INSERT FOR METAL CUTTING

RELATED APPLICATION DATA

This application is based on and claims priority under 35 U.S.C. §119 to Swedish Application No. 0401819-8, filed Jul. 9, 2004, the entire contents of which are incorporated herein by reference.

FIELD OF THE DISCLOSURE

The present disclosure relates to a coated cemented carbide cutting tool insert particularly useful for rough, medium and finishing machining of steels and cast irons preferably short chipping materials. More particularly, the disclosure relates to coated inserts in which only part of the substrate is provided with a tough surface region in such a way that improved edge strength is obtained in certain surface regions and increased wear resistance in others in the same insert.

BACKGROUND

In the discussion of the state of the art that follows, reference is made to certain structures and/or methods. However, the following references should not be construed as an admission that these structures and/or methods constitute prior art. Applicants expressly reserve the right to demonstrate that such structures and/or methods do not qualify as prior art against the present invention.

Today, coated cemented carbide inserts with binder phase enriched surface zone as disclosed, e.g., in U.S. Pat. No. 4,277,283, U.S. Pat. No. 4,610,931 and U.S. Pat. No. 4,548,786, are commonly used for turning of metals and alloys. The binder phase enriched surface zone widens the application towards tougher cutting operations, but limits the thermal resistance and the wear resistance of the surface zone.

Generally, machining of short chipping materials with coated cemented carbide tools are made with inserts with a flat rake face, without chip breakers, or with simple chip breakers, which do not have binder phase enriched surface zones.

U.S. Pat. No. 4,610,931 discloses removal of binder phase enriched surface zones on the clearance face probably in order to improve flank wear resistance.

SUMMARY

It has surprisingly been found that if the cobalt enriched surface zone on the substrate is missing on areas subjected to high temperature, mechanical load or abrasion, i.e., the rake face, an increased resistance against plastic deformation and crater wear is achieved without any substantial decrease of edge toughness. The thermal conductivity increases along with the surface hardness and as a result more favorable conditions for heat transfer and abrasion resistance of the surface occurs, which decreases the negative effects of high thermal and mechanical loads like plastic deformation, crater wear and abrasive wear.

An exemplary embodiment of a coated cutting insert for metal machining comprises a tungsten carbide-based substrate, and a binder phase enriched surface zone including at least one rake face and at least one clearance face intersecting to form a cutting edge, wherein the binder phase enriched surface zone is at least partly missing on a surface of the rake face including at least a part of the surface extending from the cutting edge.

An exemplary method of manufacturing a coated cutting insert for metal machining, the insert comprising a tungsten carbide-based substrate and a binder phase enriched surface zone including at least one rake face and at least one clearance face intersecting to form a cutting edge, comprises forming the insert by a powder metallurgical technique including milling, pressing, sintering, and removing a binder phase enriched surface zone from the formed insert in a post-sintering treatment. The binder phase enriched surface zone is removed from at least a portion of a surface of the at least one rake face, and the portion from which the binder phase enriched surface zone is removed includes at least a part of a surface extending from the cutting edge.

DETAILED DESCRIPTION

Figure 1:
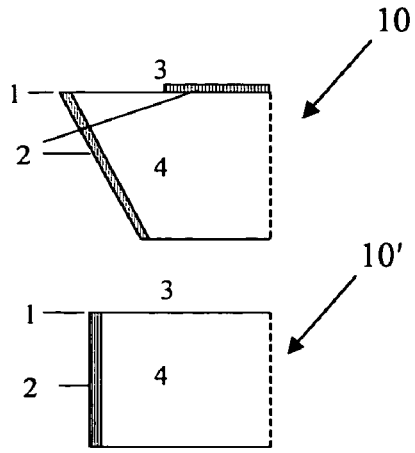
FIG. 1 shows examples of inserts according to embodiments of the invention including: a cutting edge 1, a cobalt enriched zone 2, a rake face 3, and a body 4.

According to the present disclosure, a coated cutting tool insert 10, 10' has at least one rake face 3 and at least one clearance face intersecting to form a cutting edge 1. The insert 10, 10' has a cemented carbide body 4 which is provided with an essentially cubic carbide phase free and binder phase enriched surface zone 2 that is at least partly missing on the rake face 3, including at least a part of the surface extending from the cutting edge 1.

In one embodiment, the insert 10, 10' has a flat rake face 3 where said binder phase enriched zone 2 is missing on >25%, preferably >40%, more preferably >60% of the surface of the rake face 3 but said binder phase enriched surface zone 2 is present on >25%, preferably >10%, most preferably >0% of the surface of the rake face, excluding the surface of the hole for clamping, if any. Preferably, the binder phase enriched surface zone 2 is missing in the corners of the insert, preferably in triangular areas, most preferably areas generally shaped as isosceles triangles, or along the edges of the cutting tool insert, with an essentially constant width >0.1 mm, preferably >0.25 mm.

In an optional embodiment, the binder phase enriched surface zone 2 is completely missing on the rake face 3 of the insert 10, 10'.

In an alternative embodiment, the rake face 3 is provided with a chip breaker geometry, comprising flat surfaces and depressions, in which the binder phase enrichment is missing on at least parts of the flat surfaces extending from the cutting edge and remains in the depressions. Preferably, the binder phase enriched surface zone 2 is missing along the edges of the cutting tool insert 10, 10' with an essentially constant width >0.1 mm, preferably >0.25 mm.

The binder phase enrichment is at least partly, preferably completely, present on the clearance face.

The insert is preferably negative and the binder phase enriched surface zone is thus missing at least partly on both rake faces.

In a preferred embodiment, the insert is provided with an essentially cubic carbide phase free and binder phase enriched surface zone with average binder phase content in the range 1.2-2.5 times the nominal binder phase content and a thickness of 5-50 μm.

In a further preferred embodiment, the substrate of the coated cutting tool is a cemented carbide body having a composition of 3.0-9.0 wt. %, preferably 4.0-7.0 wt. % Co, 1.0-10.0 wt. %, preferably 4.0-9.0 wt. % of cubic carbonitride forming elements from groups IVb and Vb of the periodic table, N, C and WC.

The inserts are provided with 5-25 μm thick wear resistant coatings as known in the art, preferably produced by CVD and/or MTCVD techniques. The wear resistant coatings preferably contain a layer of aluminium oxide with a thickness of 1-15 μm.

In a preferred embodiment, the cutting tool insert has a coating comprising:

- a layer of $TiC_xN_yO_z$ with $0.7 \leqq x+y+z \leqq 1$, preferably with $z \leqq 0.2$, $x>0.3$ and $y>0.2$, most preferably $x>0.4$, with a thickness of 3-14 μm, preferably 4-12 μm, most preferably 5-10 μm, with columnar grains.
- at least one layer of $Al_2O_3$, preferably $\alpha$-$Al_2O_3$, with a thickness of 2-14 μm, preferably 3-10 μm.
- the outer layer of $Al_2O_3$ can optionally be followed by further layers of $TiC_xN_yO_z$, $HfC_xN_yO_z$ or $ZrC_xN_yO_z$ or mixtures thereof with $0.7 \leqq x+y+z \leqq 1.2$, preferably with $y>x$ and $z<0.4$, more preferably $y>0.4$, most preferably $y>0.7$, with thickness<3 μm, preferably 0.4-1.5 μm, but in some optional embodiments the $Al_2O_3$ layer can also be the outermost layer.

The disclosure also relates to a method of making said coated cutting tool inserts with selected surface areas without binder phase enrichment. According to embodiments of the method, the raw materials for the cemented carbide substrate are mixed, compacted and sintered, according to normal procedures, resulting in a cutting tool insert with an essentially cubic carbide phase free and binder phase enriched surface zone.

After sintering, surface material on the rake face is removed mechanically, chemically or by any other suitable method to at least the depth of the binder phase enriched zone. The binder phase enriched zone on the clearance face is not affected and the toughness around the edge remains. After conventional post sintering treatments including edge honing, a hard wear resistant coating is applied, possibly followed by a post treatment of the coating surface, such as blasting or brushing.

EXAMPLES

Inserts tested in the following examples include:

type "A" insert according to the invention with a binder phase enriched surface zone present on cutting edge and clearance face but not on the rake face;

type "B" prior art insert with a binder phase enriched surface zone present on all surfaces delimiting the cutting edge; and type "C" insert outside the invention with the binder phase enrichment removed on all surfaces. The tested inserts (type A, type B and type C) have similar chemical composition of the cemented carbide body and similar physical bulk properties.

Example 1

Inserts consistent with type "A", were tested against inserts of type "B" and type "C". The inserts had a bulk composition of 5.3 wt % Co, 3.3 wt % Ta, 2.1 wt % Nb, 2.0 wt % Ti, 6.0 wt % C, 0.2 wt % N and as balance W. The surface zone of the insert substrates consisted of a 25 μm thick binder phase enriched part nearly free of cubic carbonitride phase. After removal of the binder phase enriched zone on the rake face surfaces, the substrates were coated with a 7 μm thick layer of $TiC_xN_yO_z$, a 5 μm thick layer of $Al_2O_3$, consisting of the $\alpha$-phase and an outer layer of nitrogen rich $TiC_xN_yO_z$ deposited to a thickness of 0.5 μm.

The inserts were tested under the following conditions.

Work piece: Cylindrical Slotted bar
Material: SS1672-08, start diameter 160 mm
Insert type: CNMA120408
Cutting speed 140 m/min
Feed: increasing from 0.1 to 1.0 mm/rev
Depth of cut: 2.0 mm
Length in cut: 10 mm
Remarks: Interrupted cut without coolant
Tool life criteria: Gradually increased feed until breakage.

Figure 2:
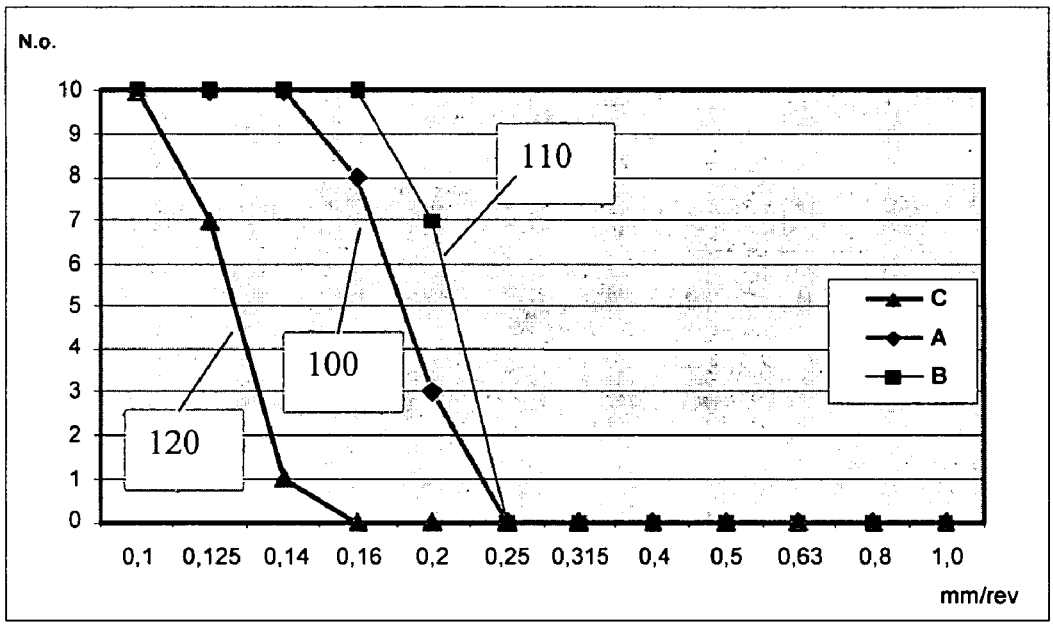
FIGS. 2-4 summarize the performance of examples of inserts under different test conditions.

The toughness of the cutting edges is shown in FIG. 2 where ten edges of each insert type (type A 100; type B 110; type C 120) were run with increasing feed until edge chipping occurred. The inserts type "C" without binder phase enriched zones showed severe edge chipping at low feeds while those according to the invention type "A" and prior art type "B" showed higher and almost equal toughness. This demonstrates that even though the binder phase enriched surface zone is removed from the rake face, the edge toughness remains almost unaffected compared to inserts with the enriched zone remaining.

Example 2

Inserts according to type "A", type "B" and type "C" were compared in continuous metal cutting at elevated speeds. The insert substrates contained 7.6 wt % Co, 2.2 wt % Ta, 2.0 wt % Nb, 1.5 wt % Ti. The surface zone of the insert substrates consisted of a 30 μm thick binder phase enriched part nearly free of cubic carbonitride phase. After removal of the gradient zone on selected surfaces, the substrates were coated with a 5 μm thick layer of $TiC_xN_yO_z$, a 8 μm thick layer of $\alpha$-$Al_2O_3$ and an outer layer of nitrogen rich $TiC_xN_yO_z$, deposited to a thickness of 0.5 μm.

The test conditions were the following:

Work piece: Cylindrical bar
Material: SS1672-08
Insert type: TPUN160308
Cutting speed 300-550 m/min
Feed: 0.3 mm/rev
Depth of cut: 2.5 mm
Remarks: No coolant was used.

Figure 3:
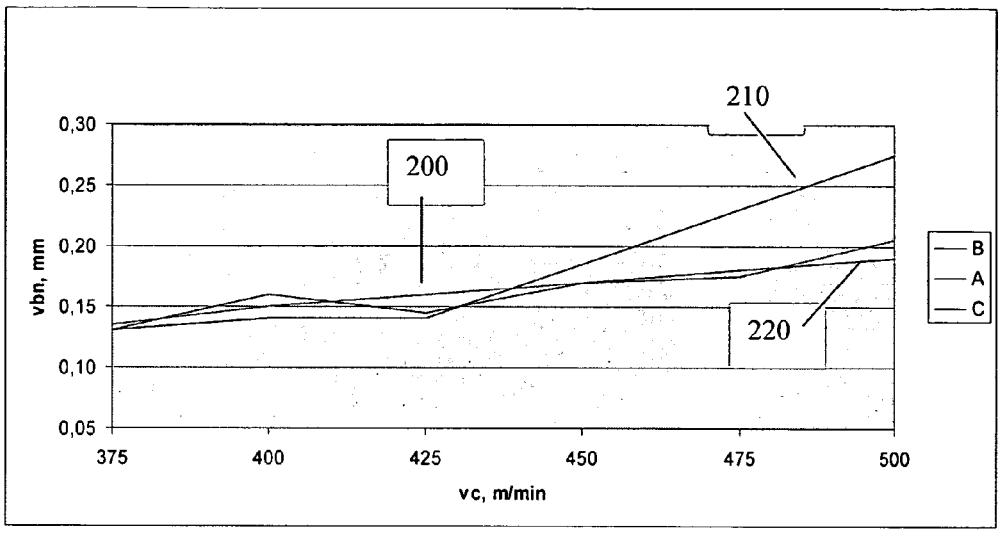

The plastic deformation and/or flank wear (vbn) was measured at the point where the nose radius begins at different cutting speeds (vc). FIG. 3 shows the results for insert type "A" 200, insert type "B" 210 and insert type "C" 220. From the results in FIG. 3 it is obvious that the inserts type "A" 200 with binder phase enriched surface zone on the cutting edge and clearance face but not on the rake face and the inserts type "C" 220 of prior art with no binder phase enrichment have a better resistance against plastic deformation and flank wear than inserts type "B" 210 according to prior art with a binder phase enriched surface zone.

Example 3

Inserts according to Example 1 were compared and the test conditions were the following:

Work piece: Hexagonal bar
Material: SS2244-05 (hardened)
Insert type: SNMA120412
Cutting speed 200 m/min
Feed: 0.15-0.3 mm/rev
Depth of cut: 1.5 mm Time in cut: 37 seconds for each cycle Remarks: Facing of hexagonal bar with heavy interrupted cuts at the beginning of each cycle, three edges of each insert type were tested.

Tool life criteria vb>0.3 mm.

Figure 4:
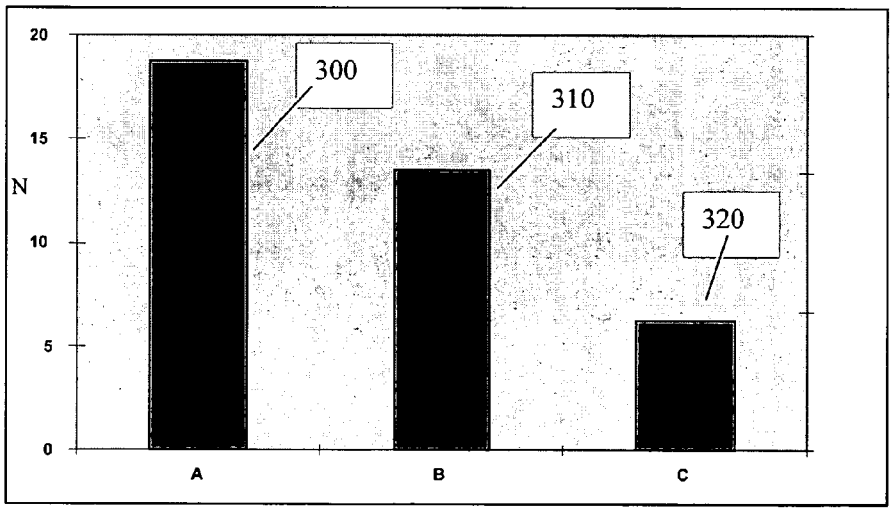

It is evident from FIG. 4, that the prior art inserts type "B" 310 and type "C" 320 experienced a noticeable shorter tool life (fewer cycles N) than type "A" 300 inserts. Notch or crater wear was the tool life limiting wear mechanism in this application. Inserts type "C" 320, without surface enriched binder phase zone, showed severe notch wear and unpredictable behaviour after just a few cycles. Inserts type "B" 310, with a surface enriched binder phase zone showed improved tool life with limited notch wear but experienced heavy crater wear leading to edge failure. For type "A" inserts 300 where the binder phase enriched zone has been removed on the rake face, notch wear was limited and crater wear was not as severe, thus leading to increased tool life.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A coated cutting insert for metal machining comprising:

a tungsten carbide-based substrate; and a binder phase enriched surface zone including at least one rake face and at least one clearance face intersecting to form a cutting edge, wherein the binder phase enriched surface zone is at least partly missing on a surface of the rake face including at least a part of the surface extending from the cutting edge, wherein the rake face is flat and the binder phase enriched surface zone is missing on greater than 25% of a surface area of the rake face and is present on greater than 10% of the surface area of the rake face.

2. The coated cutting insert according to claim 1, wherein a value of the surface area of the rake face excludes a surface area of a clamping hole.

3. The coated cutting insert according to claim 1, wherein the binder phase enriched surface zone is missing on greater than 40% of the surface area of the rake face.

4. The coated cutting insert according to claim 1, wherein the binder phase enriched surface zone is present on greater than 0% of the surface area of the rake face.

5. The coated cutting insert according to claim 1, wherein the rake face is flat and the binder phase enriched surface zone is completely missing on the surface of the rake face.

6. The coated cutting insert according to claim 1, wherein the rake face has a chip breaker geometry, the chip breaker geometry comprising a plurality of flat surfaces and a plurality of depressions, and wherein the binder phase enriched surface zone is missing on at least a portion of the flat surfaces extending from the cutting edge and the binder phase enriched surface zone is present in the depressions.

7. The coated cutting insert according to claim 1, wherein the binder phase enriched surface zone is missing along edges of the cutting tool insert forming an exposed area, a width of the exposed area along any one edge being essentially constant.

8. The coated cutting insert according to claim 7, wherein the width is greater than 0.1 mm.

9. The coated cuffing insert according to claim 8, wherein the width is greater than 0.25 mm.

10. The coated cuffing insert according to claim 1, wherein the insert is negative.

11. The coated cuffing insert according to claim 1, wherein the binder phase enriched surface zone has an average binder phase content of 1.2 to 2.5 times the nominal binder phase content and a thickness of 5 to 50 μm.

12. The coated cuffing insert according to claim 1, wherein the substrate is a cemented carbide having a composition comprising 3.0 to 9.0 wt. Co, 1.0 to 10.0 wt. % of cubic carbonitride forming elements selected from the group consisting of an element form Groups IVb and Vb of the periodic table, N, C and WC.

13. The coated cuffing insert according to claim 12, wherein the composition comprises 4.0 to 7.0 wt. % Co.

14. The coated cuffing insert according to claim 13, wherein the composition comprises 4.0 to 9.0 wt. % of cubic carbonitride forming elements.

15. The coated cutting insert according to claim 12, wherein the composition comprises 4.0 to 9.0 wt. % of cubic carbonitride forming elements.

16. The coated cutting insert according to claim 1, comprising a wear resistant coating, wherein the wear resistant coating has a thickness of 5 to 25 μm.

17. The coated cutting insert according to claim 16, wherein the wear resistant coating includes a layer of aluminium oxide with a thickness of 1 to 15 μm.

18. The coated cutting insert according to claim 16, wherein the wear resistant coating is produced by a CVD technique.

19. The coated cutting insert according to claim 16, wherein the wear resistant coating is produced by a MTCVD technique.

* * * * *